US008882548B2

(12) United States Patent
Siebens

(10) Patent No.: US 8,882,548 B2
(45) Date of Patent: Nov. 11, 2014

(54) CAM CLAMP FOR ELECTRICAL CONNECTOR

(75) Inventor: Larry N. Siebens, Asbury, NJ (US)

(73) Assignee: Thomas & Betts International LLC, Wilmington, DE (US)

( * ) Notice: Subject to any disclaimer, the term of this patent is extended or adjusted under 35 U.S.C. 154(b) by 395 days.

(21) Appl. No.: 13/234,706

(22) Filed: Sep. 16, 2011

(65) Prior Publication Data

US 2012/0088393 A1 Apr. 12, 2012

Related U.S. Application Data

(60) Provisional application No. 61/390,847, filed on Oct. 7, 2010.

(51) Int. Cl.
*H01R 11/03* (2006.01)
*H01R 4/50* (2006.01)

(52) U.S. Cl.
CPC ..... *H01R 4/5008* (2013.01)
USPC ..... 439/864

(58) Field of Classification Search
USPC ..... 439/864, 790, 792, 781, 782, 828, 822, 439/769, 773, 370; 403/374.1, 374.2, 374.5
See application file for complete search history.

(56) References Cited

U.S. PATENT DOCUMENTS

| | | | | |
|---|---|---|---|---|
| 3,709,088 | A | 1/1973 | Pitzer | |
| 4,362,415 | A | 12/1982 | Metz et al. | |
| 4,761,092 | A | 8/1988 | Nakatani | |
| 5,083,883 | A | 1/1992 | Ueda et al. | |
| 5,156,508 | A | 10/1992 | Grisley | |
| 5,255,993 | A | 10/1993 | Kovacs | |
| 5,316,492 | A | 5/1994 | Schaareman | |
| 5,615,851 | A | 4/1997 | LeBeau | |
| 5,692,930 | A * | 12/1997 | Garver et al. | 439/781 |
| 6,733,202 | B2 * | 5/2004 | Couture et al. | 403/348 |
| 6,855,012 | B2 * | 2/2005 | An | 439/793 |
| 6,884,124 | B1 | 4/2005 | Luzzi | |
| 7,249,982 | B1 | 7/2007 | Craig | |
| 7,354,319 | B2 * | 4/2008 | Camino et al. | 439/828 |
| 7,726,998 | B2 | 6/2010 | Siebens | |
| 2004/0062597 | A1 * | 4/2004 | Gilliland et al. | 403/374.1 |

* cited by examiner

*Primary Examiner* — Felix O Figueroa
(74) *Attorney, Agent, or Firm* — Snyder, Clark, Lesch & Chung, LLP

(57) ABSTRACT

A connector may include a first member having a first bore therethrough. A second member having a second bore therethrough may be configured to align with the first bore in the first member. A cam clamp may be provided for securing the first member to the second member. The cam clamp may include a pin having a head and a shaft, wherein the shaft extends through the first bore and the second bore. A compression element may be positioned between the first bore and a head on the pin. A cam member may be rotatably mounted to an end of the shaft opposing the head and configured to move between a first position and a second position. The cam clamp may be configured to secure the second member to the first member when the cam member is rotated from the first position to the second position.

17 Claims, 7 Drawing Sheets

CAM CLAMP FOR ELECTRICAL CONNECTOR

CROSS-REFERENCE TO RELATED APPLICATION

This application claims under 35. U.S.C. §119, based on priority to U.S. Provisional Patent Application No. 61/390,847, filed Oct. 7, 2010, the disclosure of which is hereby incorporated by reference herein.

BACKGROUND OF THE INVENTION

The present invention relates to electrical cable connectors, such as connectors for joining two or more electrical cables, loadbreak connectors, and deadbreak connectors. More particularly, aspects described herein relate to an electrical cable connector that allows for rapid connection and disconnection of the connector.

DETAILED DESCRIPTION OF THE PREFERRED EMBODIMENTS

The following detailed description refers to the accompanying drawings. The same reference numbers in different drawings may identify the same or similar elements.

Figure 1:
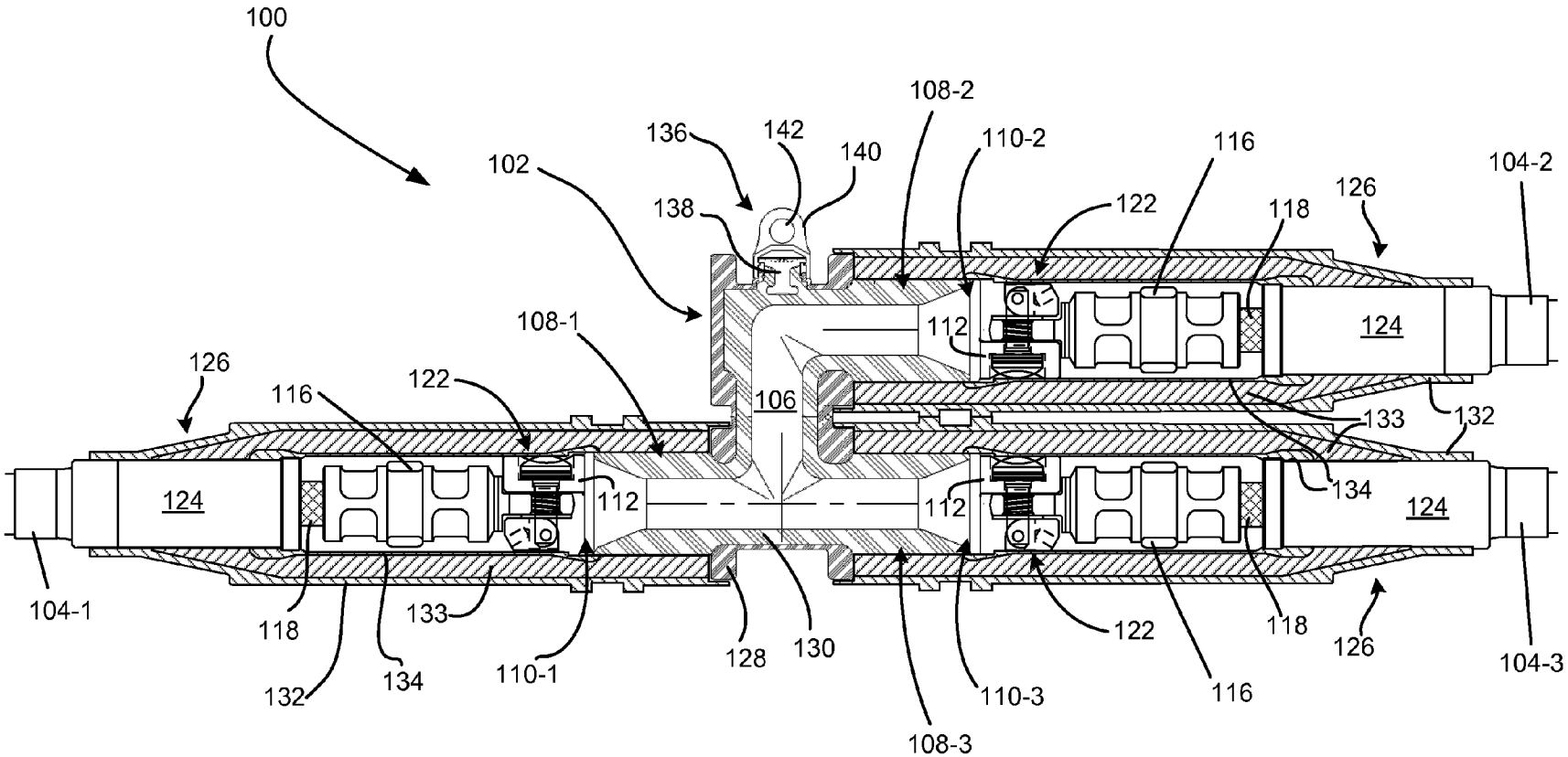
FIG. 1 is a schematic cross-sectional diagram illustrating a power cable yoke assembly consistent with implementations described herein.

FIG. 1 is a schematic cross-sectional diagram illustrating an exemplary power cable splicing assembly 100 consistent with implementations described herein. As shown in FIG. 1, power cable splicing connector 100 may include a three-way (e.g., a "Y") yoke 102 for enabling connection of power cables 104-1, 104-2, and 104-3 (collectively "power cables 104," and individually "power cable 104-x"). For example, power cable 104-1 may be a supply cable and cables 104-2 and 104-3 may be load cables. Although described for used with yoke 102, other types of power cable connectors may be configured in accordance with implementations described herein, such as four-way yoke connectors, two-way connectors, etc.

In one implementation, yoke 102 of power cable splicing connector 100 may include a central conductor 106 (also referred to as bus bar 106) and number of taps 108-1 to 108-3 (collectively "taps 108," and individually "tap 108-x"). Central conductor 106 may be formed of a suitably conductive material, such as copper, aluminum, or other conductive alloy. Further, as shown in FIG. 1, central conductor 106 may include bus extensions 110-1 to 110-3 (collectively "bus extensions 110," and individually "bus extension 110-x") that project from respective taps 108-x in yoke 102. As described in additional detail below, central conductor 106 may connect each of power cables 104-x to each other power cable 104-x, such that power applied to one cable is transferred to each other cable.

Bus extensions 110 may be configured to receive connector portions of power cables 104 in the manner consistent with embodiments described herein. For example, each bus extension 110-x may include a spade portion 112 (also referred to as yoke spade portion 112) having a bore 114 (shown in FIG. 2) therethrough. Each power cable 104 may be prepared by connecting the power cable 104 to a crimp connector 116. Crimp connector 116 may include a substantially cylindrical assembly configured to receive a cable conductor 118 of power cable 104-x therein. During preparing of power cable 104-x, a portion of crimp connector 116 may be physically deformed (e.g., crimped) to fasten crimp connector 116 to cable conductor 118.

Crimp connector 116 may include a forward spade portion 120 (shown in FIGS. 4A-4C) (also referred to as crimp connector spade portion 120) configured to be securely fastened to a spade portion 112 of bus extension 110-x of central conductor 106. For example, forward spade portions 120 of each crimp connector 116 may include an opening therein (described below) configured to align with bore 114 in yoke spade portion 112. Consistent with implementations described herein, a cam clamp 122 may be used to secure crimp connector spade portion 120 to yoke spade portion 112 of bus extension 110. The structure and function of cam clamp 122 is described in additional detail below with respect to FIGS. 2A-6B. In the embodiment of FIG. 1, power cable splicing connector 100 may include three cam clamps 122.

As shown in FIG. 1, each of the prepared power cables 104 may further include an adapter 124 disposed rearwardly relative to crimp connector 116. Adapter 124 may be affixed to power cable 104-x and may provide a frictional engagement with a rearward portion of respective cable receptacles 126. In one implementation, adapter 124 may be formed of an insulative material, such as rubber, a thermoplastic, or epoxy.

As shown in FIG. 1, each tap 108-x includes a cable receptacle interface that includes a substantially cylindrical flange or cuff portion configured to frictionally engage a cable receptacle 126-x (individually, cable receptacle 126-x, or collectively, cable receptacles 126). For example, an inside diameter of a forward end of cable receptacle 126-x may be sized to frictionally engage the cuff portion of tap 108-x. Each cable receptacle 126 be substantially cylindrical and may be configured to surround and protect an interface between power cables 104 and bus extensions 110.

Yoke 102 may include a semi-conductive outer shield 128 formed from, for example, a peroxide-cured synthetic rubber, commonly referred to as EPDM (ethylene-propylene-diene-emonomer). Within shield 128, yoke 102 may include an insulative inner housing 130, typically molded from an insulative rubber or epoxy material. Central conductor 106 may be enclosed within insulative inner housing 130.

Regarding cable receptacles 126, each cable receptacle 126-x may include an EPDM outer shield 132 and an insulative inner housing 133, typically molded from an insulative rubber or epoxy material. Cable receptacle 126-x further includes a conductive or semi-conductive insert 134 having a bore therethrough. Upon assembly, cable receptacle 126 surrounds the interface between power cable 104-x and bus extension 110-x. In one implementation, forward ends of insert 134 and outer shield 132 may be configured to frictionally engage a portion of yoke inner housing 130 at each tap 108 upon assembly of splicing connector 100, thereby ensuring the electrical integrity of splicing connector 100.

In one exemplary implementation, power cable splicing connector 100 may include a voltage detection test point assembly 136 for sensing a voltage in splicing connector 100. Voltage detection test point assembly 136 may be configured to allow an external voltage detection device, to detect and/or measure a voltage associated with splicing connector 100.

For example, as illustrated in FIG. 1, voltage detection test point assembly 136 may include a test point terminal 138 embedded in a portion of yoke inner housing 130 and extending through an opening within yoke outer shield 128. In one exemplary embodiment, test point terminal 138 may be formed of a conductive metal or other conductive material. In this manner, test point terminal 138 may be capacitively coupled to the electrical conductor elements (e.g., central conductor 106) within splicing connector 100.

Consistent with implementations described herein, a test point cap 140 may sealingly engage portion test point terminal 138 and outer shield 128. In one implementation, test point cap 140 may be formed of a semi-conductive material, such as EPDM compounded with conductive additives. When test point terminal 138 is not being accessed, test point cap 140 may be mounted on test point assembly 136. Because test point cap 140 is formed of a conductive or semi-conductive material, test point cap 140 may ground the test point when in position. Test point cap 140 may include an aperture 142 for facilitating removal of test point cap 140, e.g., using a hooked lineman's tool.

Figure 2A:
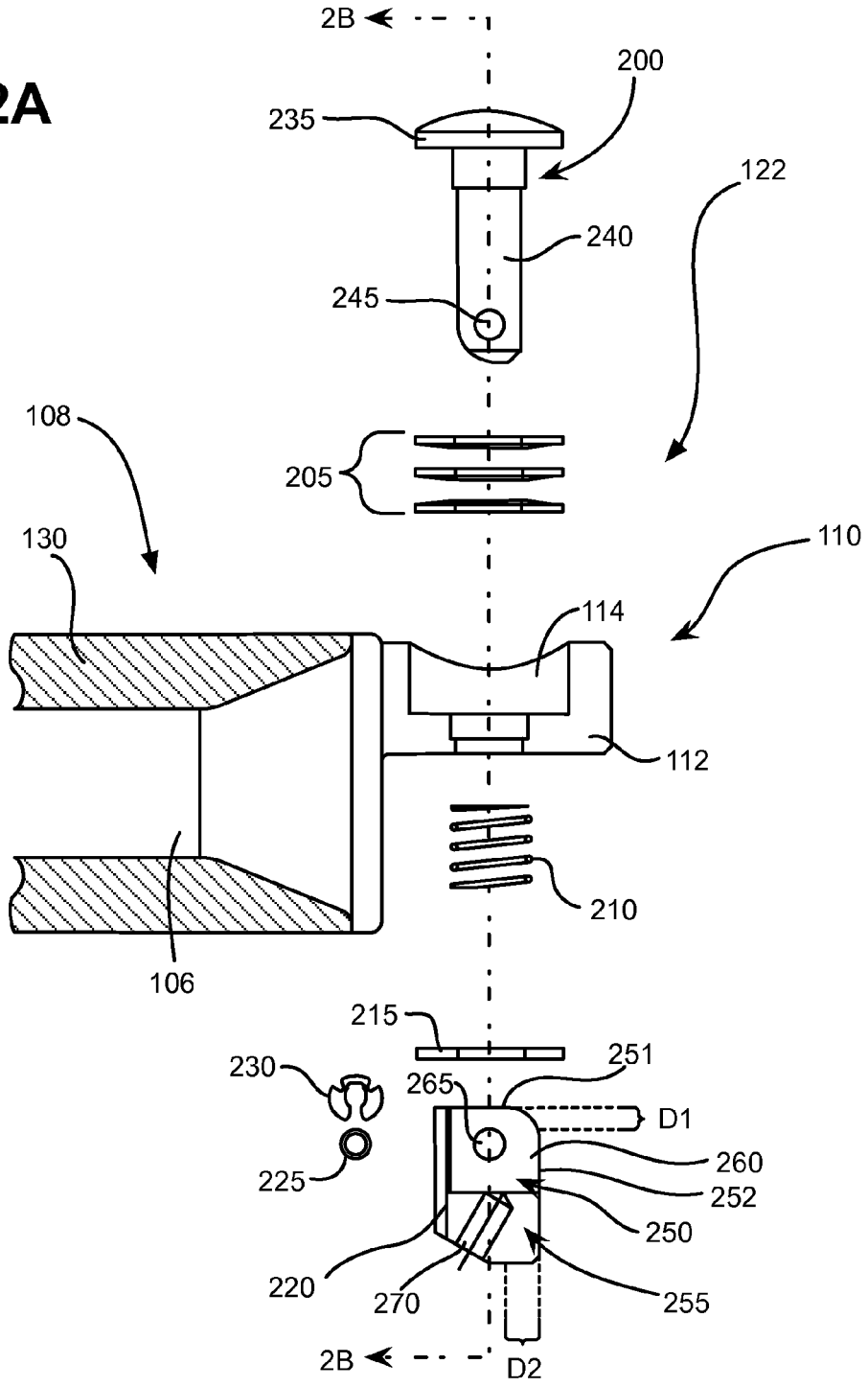
FIG. 2A is an exploded, schematic, partial cross-sectional diagram illustrating a portion of the power cable yoke assembly and one of the cam clamps of FIG. 1.
Figure 2B:
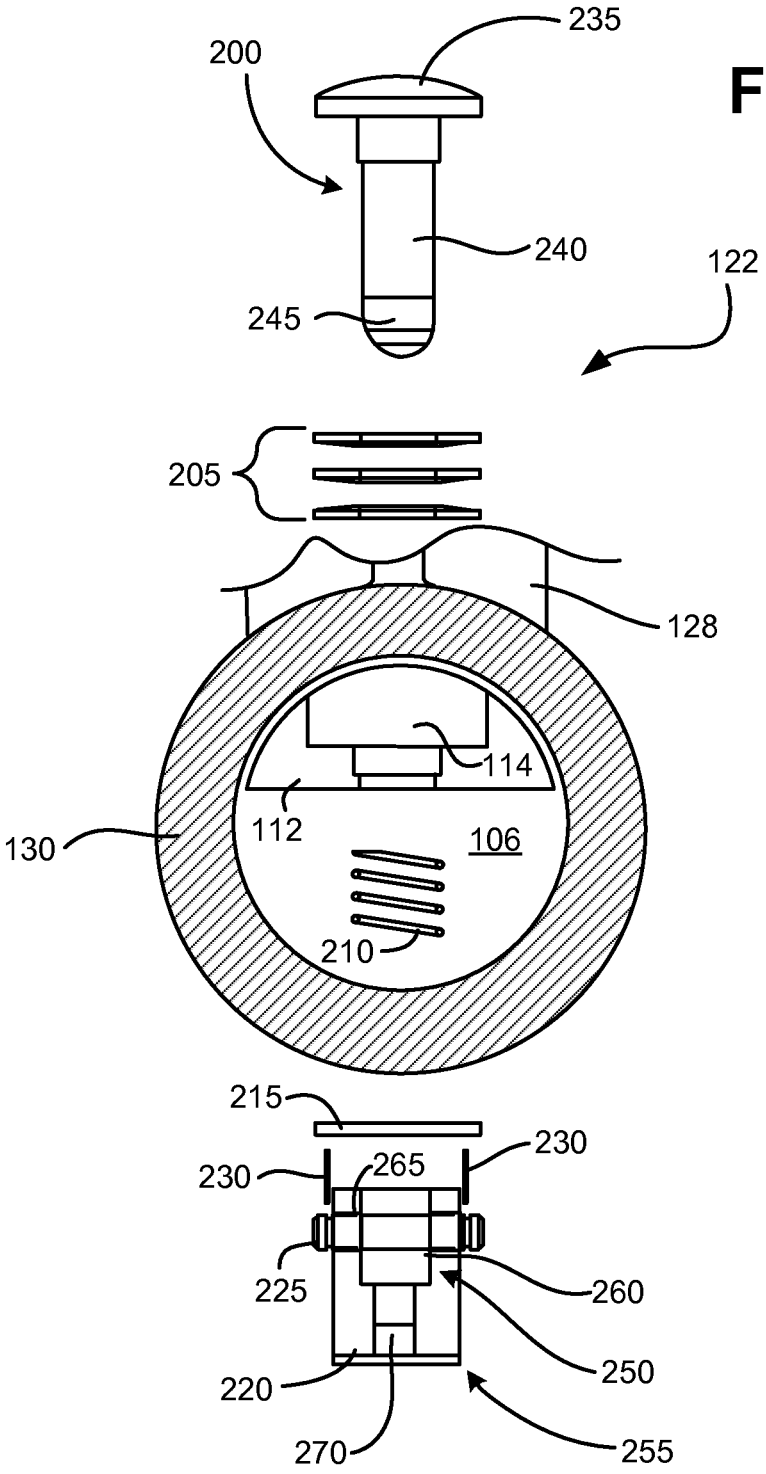
FIG. 2B is an exploded, schematic, partial cross-sectional diagram illustrating the portion of the power cable yoke assembly and cam clamp taken along the line 2B-2B in FIG. 2A.
Figure 3:
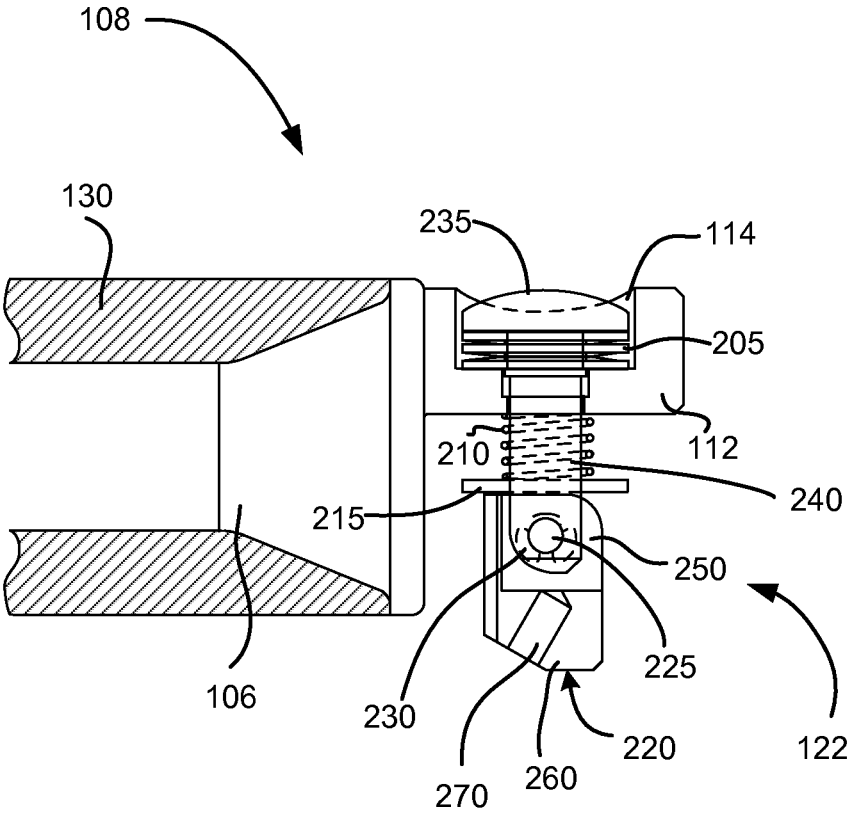
FIG. 3 is a schematic, partial cross-sectional diagram of the portion of the power cable yoke assembly and cam clamp of FIGS. 2A and 2B in an assembled state.

FIG. 2A is an exploded, schematic, partial cross-sectional diagram illustrating a portion of yoke 102 including a portion of center conductor 106, and spade portion 112 of bus extension 110, and one of the cam clamps 122 of FIG. 1. FIG. 2B is an exploded, schematic, partial cross-sectional diagram illustrating the portion of yoke 102 and cam clamp 122 taken along the line 2B-2B in FIG. 2A. FIG. 3 is a schematic, partial cross-sectional diagram showing assembly and installation of cam clamp 122 in yoke 102.

As shown, in FIGS. 2A and 2B, cam clamp 122 may include a cam clamp pin 200, compression element 205, gap spring 210, washer 215, cam member 220, pivot pin 225, and retaining member(s) 230. Cam clamp pin 200 may be substantially bolt-like and may include a head portion 235, and a shaft portion 240. During assembly of cam clamp 122, cam clamp pin 200 is received in bore 114 in spade portion 112, such that shaft portion 240 projects through bore 114. Shaft portion 240 may include a transverse bore 245 therethrough for receiving a pivot pin 225, as described in detail below. In some implementations, bore 114 may include an enlarged upper opening for receiving a head portion 235 in a recessed manner (relative to an outside surface of spade portion 112).

Compression element 205 may include an element or combination or elements configured to provide resilient compression between head portion 235 of cam clamp pin 200 and spade portion 112 of bus extension 110. That is, compression element 205 may exert a biasing force between cam clamp pin 200 and spade portion 112. As described below, when cam member 220 is placed into its clamping position, compression elements 205 may cause a predetermined amount of force to be applied against spade portion 112 of bus extension 110 and forward spade portion 120 of crimp connector 116, thereby securing power cable 104 to yoke 102. Although secure, the resilient nature of compression element 205 may allow some movement of forward spade portion 120 relative to yoke spade portion 112 when cam member 220 is placed into its clamping position. This relative movement capability prevents or substantially reduces a likelihood that spade portion 120 or yoke spade portion 112 will break upon movement of yoke 102 or power cable 104.

In one implementation, compression element 205 includes a number of resilient washers or wave springs, each having a bore therethrough for shaft portion 240 of cam clamp pin 200. For example, as shown in FIGS. 2A-3, compression element 205 includes three concave (e.g., Belleville) washers. Each washer 205 may be positioned relative to the other washers 205, such that compression of the washer exerts a known amount of resilient force. Furthermore, in one embodiment, washers 205 may be sized to fit within the upper opening of bore 114. Washers 205 may be formed of any suitable material, such as spring steel, stainless steel, etc. In other implementations, compression element 205 may include a spacer formed of a resilient material, such as a rubber or polymer.

Gap spring 210 may include a resilient member configured to maintain washer 215 and cam member 220 in a spaced relationship relative to spade portion 112 of bus extension 110 prior to connection of crimp connector spade portion 120. For example, as shown in FIG. 4B, gap spring 210 may be configured to maintain washer 215 a distance D3 from a lower portion of spade portion 112, where D3 is at least slightly larger than D4, the thickness of crimp connector spade portion 120. By maintaining distance D3, gap spring 210 prevents cam clamp 122 from unnecessary movement within bore 114 that would make connecting crimp connector spade portion 120 to cam clamp 122 difficult. In exemplary embodiments, gap spring 210 may include a helical spring formed of a resilient material, such as spring steel, stainless steel, plastic, rubber, etc.

Figure 5:
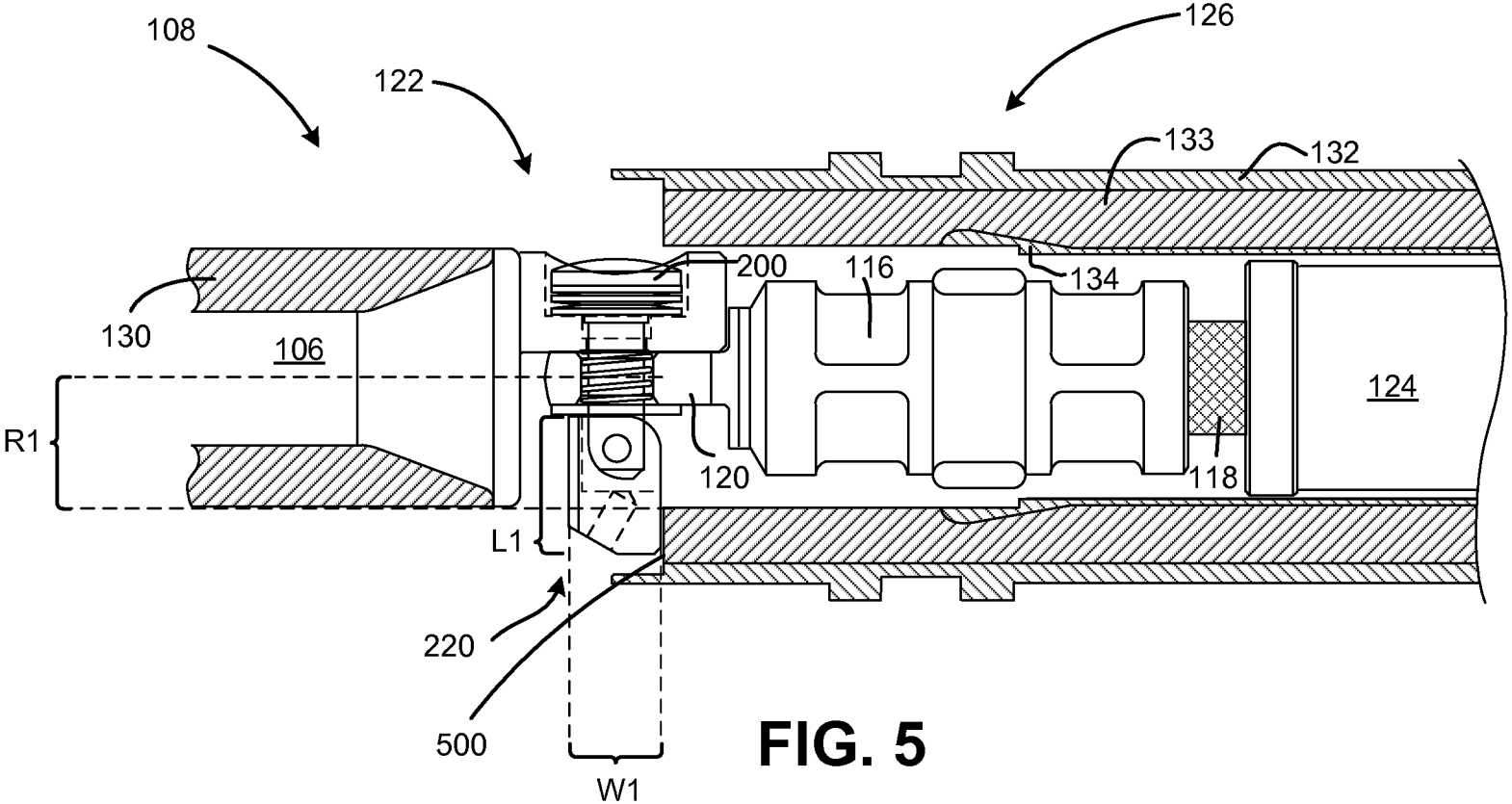
FIG. 5 is a schematic, partial cross-sectional diagram of the connected power cable spade assembly of FIG. 4C illustrating an uninstalled receptacle.

Washer 215 may include a flat washer or similar element for providing a substantially flat biasing surface between gap spring 210 and spade portion 112. In addition, as described below, washer 215 may provide substantially flat biasing surface between gap spring 210 and cam member 220. In some implementations, washer 215 may include a plate, spacer, or other non-circular element. In addition, in some embodiments, washer 215 may include a resilient or compressive element, such as a wave washer or spring, for providing increased compressive force upon engagement of cam member 220. Washer 215 may be formed of a semi-rigid or rigid material, such as hardened steel, spring steel, stainless steel, plastic, etc, Cam member 220 may include a pin receiving portion 250 and a tool engagement portion 255. As shown in FIG. 5, a total length L1 of cam member 220 may be configured to prevent installation of receptacle 126 over cam clamp 122 prior to compression of cam member 220 (e.g., via rotation of cam member 220 relative to cam clamp pin 200). In one implementation, L1 is ranges from approximately 1 inch to approximately 1.375 inches. Furthermore, a width W1 of cam member 220 may be less than length L1, and may range from approximately 0.5 inches approximately 0.75 inches.

More specifically, as shown in FIG. 5, receptacle 126 may include an inside radius R1 that defines a distance from a central axis of receptacle 126 to an inside surface of insulative inner housing 133. Consistent with embodiments described herein, length L1 of cam member 220 may be sufficient to cause at least a portion of cam member 220 to project from a central axis of receptacle 126 a distance greater than R1, when cam member 220 is in an uncompressed position. In this manner, any attempt to install receptacle 126 on power cable 104 and yoke 102 prior to compression of cam member 220 will cause forward end 500 of receptacle 126 to abut cam member 220, thereby preventing installation of receptacle 126.

Upon compression of cam member 220 (in the manner described below), cam member 220 is rotated such the projection of cam member 220 from the central axis of receptacle 126 is reduced (e.g., by L1-W1). This reduced projection enables receptacle 126 to be installed on yoke 102.

Returning to FIGS. 2A and 2B, pin receiving portion 250 may include a recess or slot 260 formed in cam member 220 and sized to receive an end of cam clamp pin 200 therein. Pin receiving portion 250 may include a transverse bore 265 therethrough configured to align with bore 245 in pin shaft portion 240 following insertion of pin 200 into pin receiving portion 250. During assembly, cam clamp pin 200 may be placed through compression elements 205, bore 114 in yoke spade portion 112, gap spring 210, washer 215, and received into pin receiving portion 250 of cam member 220.

Bore 265 in cam member 220 may be spaced a predetermined distance from the edges of cam member 220. For ease of understanding, a first edge of cam member 220 may be referred to as uncompressed edge 251 and a second edge of cam member 220 may be referred to as compressed edge 252. The distance from the outside diameter of bore 265 to uncompressed edge 251 is shown as D1 and the distance from the outside diameter of bore 265 to compressed edge 252 is shown as D2. The relative difference between distance D1 and distance D2 establishes the clamp displacement of cam clamp 122 as described below. An optimal ratio between D1 and D2 is based on an amount of compression applied by compression element 205. A corner of cam member 220 between uncompressed edge 251 and compressed edge 252 may be rounded to increase the ease in transitioning cam member 220 between uncompressed edge 251 and compressed edge 252.

Pivot pin 225 may be sized to fit through bore 265 in cam member 220 and bore 245 in cam clamp pin 200. Pivot pin 225 may be secured within bores 265/245 by one or more retaining members 230. In some implementations, retaining members 230 may include snap rings or similar elements to retain pivot pin 225 within bores 265/245. In other implementations, retaining members 230 may include threaded nuts, end caps, or rivets.

Installation of pivot pin 225 in bores 265/245 rotatably secures pin 200 to cam member 220. As shown, slot 260 in pin receiving portion 250 of cam member 220 may enable rotational movement of cam member 220 relative to washer 215.

Tool engagement portion 255 of cam member 220 may include a cavity 270 for receiving a tool therein. In one implementation, cavity 270 may be substantially cylindrical and may be sized to receive a tool, such as a screwdriver. Cavity 270 may be angled with respect to a longitudinal axis of cam member 220 to provide a maximum range of motion during engagement of cam member 220 in the manner described below.

In an initial uncompressed state, uncompressed edge 251 may be provided adjacent washer 215. In this state, crimp connector spade portion 120 may be received on cam clamp pin 200. Rotation of cam member 220 about pivot pin 225 (e.g., via rotation of a tool receive in cavity 270) places compressed edge 252 adjacent to washer 215 and increases the effective width of cam member 220 (by the difference between D2 and D1). This causes compression element 205 to apply compressive forces to crimp connector spade portion 120, thereby securing crimp connector spade portion 120 to yoke spade portion 112.

Figure 4A:
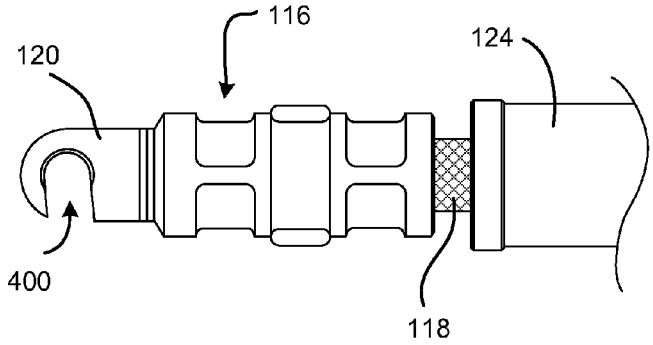
FIG. 4A is a schematic, plan view diagram of a power cable spade assembly consistent with implementations described herein.
Figure 4B:
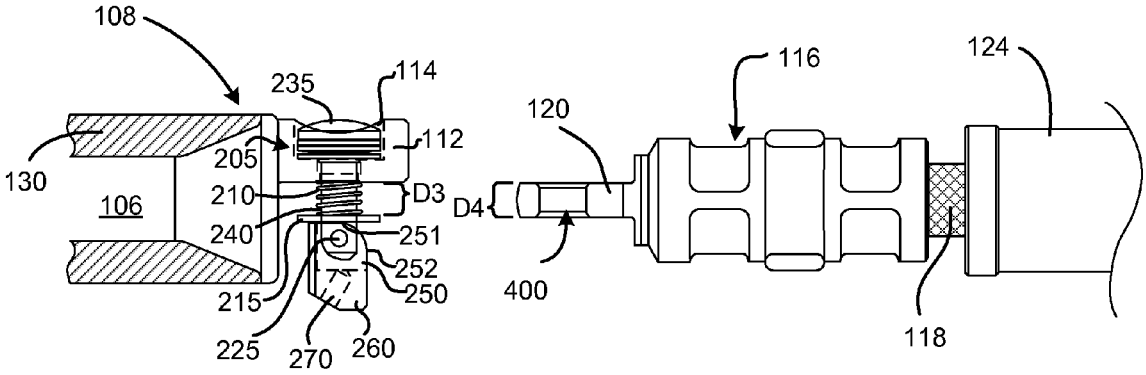
FIGS. 4B and 4C illustrate connection of the power cable spade assembly of FIG. 4A to the power cable yoke assembly and cam clamp of FIG. 3.

FIG. 4A is a top view of an exemplary crimp connector 116 and crimp connector spade portion 120. As shown crimp connector spade portion 120 may include an opening 400 therein for enabling crimp connector spade portion 120 to be installed around gap spring 210 and cam clamp pin 200 following initial assembly of cam clamp 122 to yoke spade portion 112. In one implementation, a width of opening 400 may be substantially equal to an outside diameter of gap spring 210.

Figure 4C:
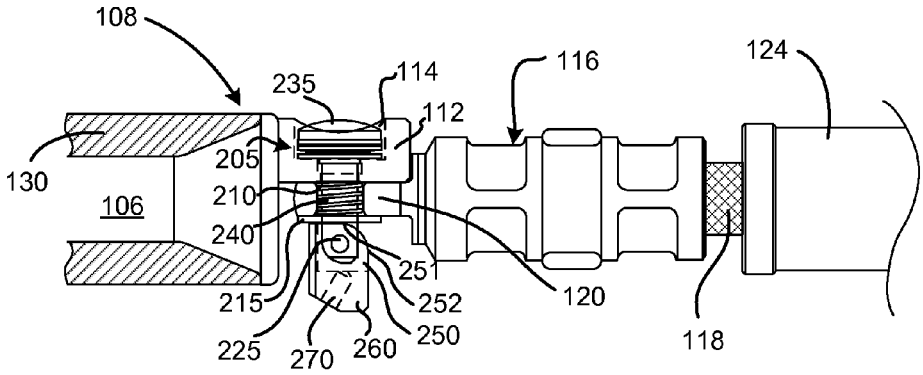

FIGS. 4B and 4C illustrated connection of the crimp connector 116 to cam clamp 122 installed on yoke spade portion 112. As shown, opening 400 in crimp connector spade portion 120 may be aligned with gap spring 210 and pin 200 of the installed cam clamp 122. Gap spring 210 may maintain washer 215 a distance D3 from an opposing surface of yoke spade portion 112. As described above, the width D4 of crimp connector spade portion 120 is slightly less than D3 thereby allowing opening 400 of crimp connector spade portion 120 to receive gap spring 210 and pin 200, as shown in FIG. 4C.

Figure 6A:
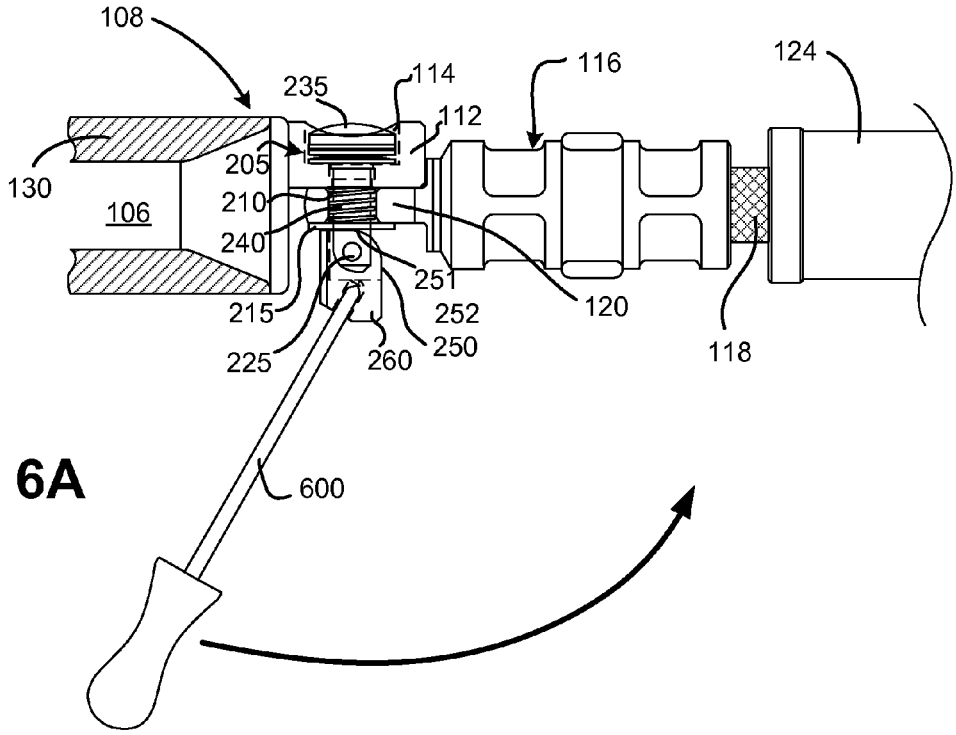
FIGS. 6A and 6B are schematic, partial cross-sectional diagrams illustrating clamping of the cam clamp of FIGS. 3-5.
Figure 6B:
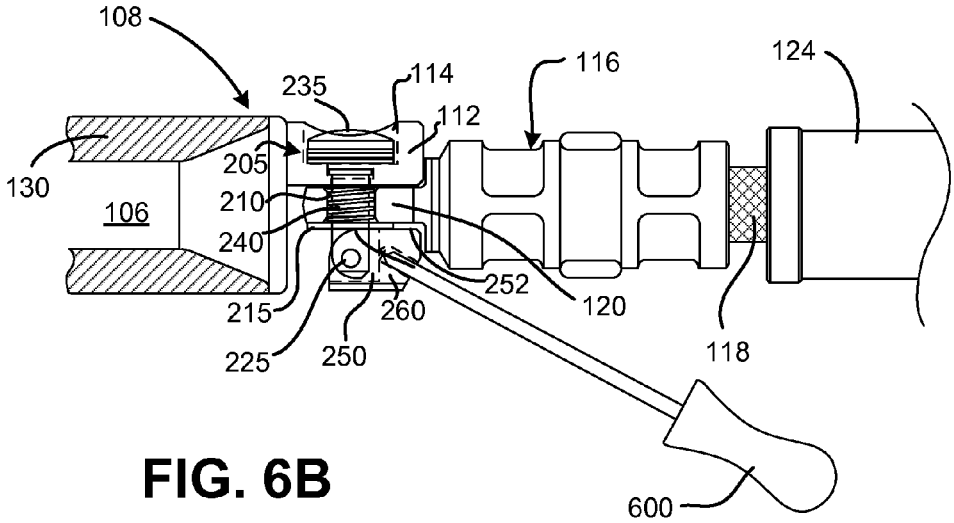

FIGS. 6A and 6B are schematic, partial cross-sectional diagrams illustrating clamping of the cam clamp 122. As shown in FIG. 6A, when in an initial uncompressed or "open" state, uncompressed edge 251 may be provided adjacent washer 215. A suitable tool 600, such as a screwdriver or the like, may be inserted into cavity 270 to affect rotation of cam member 220 about pivot pin 225. Rotation of tool 600 (as shown by the arrow in FIG. 6A) may cause cam member 220 to rotate about pivot pin 225, thereby placing compressed edge 252 of cam member 220 adjacent to washer 215 (e.g., into a compressed or "closed" state). This in turn causes pin 200 to be further drawn into slot 260 in cam member 220, thereby causing compression element 205 to compress and impart compressive forces between washer 215 and the opposing surface of yoke spade portion 112, effectively securing crimp connector spade portion 120 to yoke spade portion 112 in a resilient manner.

Following "closing" of cam member 220, tool 600 may be removed. Cable receptacle 126 may be moved into overlying position over cam clamp 122, as shown in FIG. 1.

The above-described cam type clamp assembly provides an effective and repeatable means for securing power cable spade assemblies together. More specifically, a cam clamp assembly may be provided that includes a cam clamp pin, one or more compression elements, and a cam member rotatable secured to an end of the cam clamp pin after the cam clamp pin is installed in one of the spade assemblies. Once the other spade assembly is installed onto the cam clamp pin, the cam member is moved from an open position to a closed position, thus compressing the compression element and securing the two spade assemblies together. In addition, consistent with aspects described herein, the above described cam clamp assembly prevents unsecured and unsafe assembly by disabling installation or connection of power cable receptacles unless the cam clamps are in their closed positions. In addition, the above described cam clamp electrical connector may be installed to a desired compression without requiring the use of a torque wrench of other complex/expensive tools.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as high voltage switchgear equipment, including 15 kV, 25 kV, or 35 kV equipment.

For example, various features have been mainly described above with respect to electrical connectors, and splicing or yoke-type connectors in particular. In other implementations, other medium/high voltage power components may be configured to include the connection mechanism configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A connector comprising:

a first member having a first bore therethrough;

a second member having a second bore therethrough configured to align with the first bore in the first member; and a cam clamp for securing the first member to the second member, wherein the cam clamp comprises:

a pin having a head and a shaft, wherein the shaft extends through the first bore and the second bore;

a compression element positioned between the first bore and the head of the pin;

a cam member coupled to an end of the shaft opposing the head and configured to move between a first position and a second position, wherein the cam clamp is configured to secure the second member to the first member when the cam member is rotated from the first position to the second position; and a gap spring positioned on the pin between the first member and the cam member for maintaining the cam member spaced from the first member prior to insertion of the second member.

2. The connector of claim 1, wherein moving the cam member from the first position to the second position causes compression of the compression element.

3. The connector of claim 1, wherein the compression element comprises one or more springs.

4. The connector of claim 3, wherein the one or more springs comprise one or more concave washers.

5. The connector of claim 1, wherein the cam clamp is further configured to receive the second bore of the second member between the cam member and the first member.

6. The connector of claim 5, wherein the second bore of the second member comprises an opening for allowing the second bore to engage the cam clamp when the cam member is in the first position.

7. The connector of claim 1, wherein the gap spring comprises a helical spring surrounding the shaft of the pin between the cam member and the first member.

8. The connector of claim 1, wherein the cam member comprises a slot therein for receiving the end of the shaft, wherein the shaft and the cam member each comprise transverse bores therethrough, wherein the transverse bores are aligned following insertion of the shaft into the slot, and wherein the cam clamp further comprises a pivot pin that extends through the transverse bores for rotatably securing the cam member to the shaft.

9. The connector of claim 8, wherein a distance between the transverse bores in the cam member and a first edge of the cam member is less than a distance between the transverse bores in the cam member and a second edge of the cam member, and wherein moving the cam member from the first position to the second position causes an engaging surface of the cam member to transition from the first edge to the second edge.

10. The connector of claim 1, wherein the cam member comprises a tool receiving portion for receiving a tool therein, and wherein rotation of the tool in the tool receiving portion causes the cam member to move from the first position to the second position.

11. The connector of claim 1, wherein the first member is a first electrical device and the second member is a second electrical device, and wherein a length of the cam member in the first position is sufficient to prevent installation of a receptacle cover over the second member.

12. The connector of claim 11, wherein the first member comprises a first spade assembly coupled to a high voltage power cable yoke and the second member comprises a second spade assembly coupled to a high voltage power cable.

13. An electrical connector assembly for connecting a first electrical component to a second electrical component, comprising:

a cam clamp pin having a head and a shaft, the shaft comprising a transverse bore therethrough at an end opposite to the head;

a compression element for positioning on the pin proximate the head; and a cam member configured to rotatably mount to the transverse bore and configured to move between a first position and a second position; and a gap spring positioned on the cam clamp pin between the first electrical component and the cam member and configured to maintain the cam member in a spaced relationship with the first electrical component prior to positioning of the second electrical component, wherein the cam clamp pin is inserted through a first bore in the first electrical component so that the compression element engages the head, wherein the second electrical component is positioned between the first electrical component and the cam member, and wherein movement of cam member the between the first position and the second position causes the compression element to exert a compressive force between the cam member, the second electrical component and the first electrical component.

14. The electrical connector assembly of claim 13, wherein movement of cam member the between the first position and a second position comprises rotational movement about a pivot pin extending through the transverse bore.

15. The electrical connector assembly of claim 13, wherein a length of the cam member is sufficient to prevent installation of a cover over the first electrical component and the second electrical component when the cam member is in the first position.

16. A method for connecting a first electrical component to a second electrical component, comprising:

positioning a compression element on a cam clamp pin having a shaft and a head;

inserting the shaft of the cam clamp pin in a bore in the first electrical component;

inserting a gap spring on the shaft, coupling a cam member to an end of the shaft opposite to the head, wherein the gap spring is configured to maintain the cam member in a spaced relationship with the first electrical component;

receiving the second electrical component in a gap between the cam member and the first electrical component; and rotating the cam member between a first position and a second position to secure the second electrical component to the first electrical component.

17. The method of claim 16, further comprising:

rotating the cam member the between the second position and the first position to unsecure the second electrical component from the first electrical component.

* * * * *